US007096617B2

(12) United States Patent
Bydalek et al.

(10) Patent No.: US 7,096,617 B2
(45) Date of Patent: Aug. 29, 2006

(54) INTERNALLY ILLUMINATED BATTERY POWERED PROGRAMMABLE TAP HANDLE SYSTEM WITH INTERCHANGEABLE TRANSLUCENT HEADS

(76) Inventors: Edward William Bydalek, 41 Northcote Rd., Brentwood, MO (US) 63144; Walter F. Lewis, 10271 Meadowood, Overland, MO (US) 63114; Leonard R. Missler, 1079 Eaglepass Ct., Chesterfield, MO (US) 63017

( * ) Notice: Subject to any disclaimer, the term of this patent is extended or adjusted under 35 U.S.C. 154(b) by 75 days.

(21) Appl. No.: 10/783,664

(22) Filed: Feb. 20, 2004

(65) Prior Publication Data

US 2004/0163288 A1 Aug. 26, 2004

Related U.S. Application Data

(60) Provisional application No. 60/448,999, filed on Feb. 20, 2003.

(51) Int. Cl.
*G09F 3/00* (2006.01)

(52) U.S. Cl. ..... 40/332; D7/395; D7/398; 222/113; 222/469

(58) Field of Classification Search ..... 40/332; D7/393, 395, 398; 222/23, 638, 113, 469; 340/815.45; 362/399
See application file for complete search history.

(56) References Cited

U.S. PATENT DOCUMENTS

| | | | | |
|---|---|---|---|---|
| 2,145,761 | A | 1/1939 | Fisher | |
| 2,295,468 | A | 9/1942 | Haley | |
| 2,631,393 | A | 3/1953 | Hetherington | |
| 3,286,385 | A | 11/1966 | Tate, Jr. | |
| 3,321,861 | A | 5/1967 | Tate, Jr. | |
| 3,752,192 | A | 8/1973 | Kleppin | |
| 3,762,086 | A | 10/1973 | Horbinski | |
| 4,225,057 | A | 9/1980 | Horn | |
| 4,229,893 | A | 10/1980 | Uys Naude | |
| 4,337,402 | A * | 6/1982 | Nowakowski | 307/121 |
| 4,501,422 | A | 2/1985 | Leshik | |
| 4,894,647 | A | 1/1990 | Walden, Jr. et al. | |
| 4,979,641 | A | 12/1990 | Turner | |
| D354,656 | S | 1/1995 | Strawbridge | |
| 5,412,547 | A * | 5/1995 | Hornblad et al. | 362/183 |
| 5,491,691 | A | 2/1996 | Shtayer et al. | |
| 5,586,617 | A | 12/1996 | England et al. | |
| 5,586,691 | A * | 12/1996 | Gotch et al. | 222/113 |
| 5,619,182 | A * | 4/1997 | Robb | 340/479 |
| 5,750,905 | A | 5/1998 | Weimer et al. | |
| D396,994 | S | 8/1998 | Carrino | |
| D411,710 | S | 6/1999 | Watters et al. | |
| 5,908,142 | A | 6/1999 | Sacchetti | |
| 6,082,868 | A * | 7/2000 | Carpenter | 362/96 |
| 6,297,438 | B1 * | 10/2001 | Por Paul | 84/600 |
| 6,457,840 | B1 * | 10/2002 | Maglica et al. | 362/183 |
| 2003/0214259 | A9 * | 11/2003 | Dowling et al. | 315/312 |
| 2003/0233775 | A1 * | 12/2003 | Klopfer | 40/564 |
| 2004/0090797 | A1 * | 5/2004 | Cohen | 362/577 |

* cited by examiner

*Primary Examiner*—Gary C. Hoge
(74) *Attorney, Agent, or Firm*—Polster, Lieder, Woodruff & Lucchesi, LC

(57) ABSTRACT

The present disclosure provides a draft beverage tap handle. The handle includes a body portion and a handle portion. The body portion includes a battery, a light source, a microprocessor, a motion sensor, and a timer. The microprocessor controls electrical current supplied to the light source from the battery. The motion sensor detects when the beverage tap handle has been moved to dispense a beverage. The timer causes electrical current to be interrupted to the light source from the battery when a predetermined period of time has expired. The handle portion is made from a translucent material having an internal cavity for accepting the body portion.

31 Claims, 8 Drawing Sheets

INTERNALLY ILLUMINATED BATTERY POWERED PROGRAMMABLE TAP HANDLE SYSTEM WITH INTERCHANGEABLE TRANSLUCENT HEADS

CROSS REFERENCE TO RELATED APPLICATIONS

This application claims the benefit of U.S. Provisional Patent Application Ser. No. 60/448,999, filed Feb. 20, 2003, the contents of which are expressly incorporated herein by reference.

BACKGROUND OF THE INVENTION

This invention relates generally to illuminated devices used for the purpose of promoting or calling attention to a particular brand of beer or other liquid product which is dispensed through a tap and sold where the invention is used, and more particularly to the handles that attach to the devices that dispense the product. While the invention is described with particular reference to liquid tap applications, those skilled in the art will recognize the wider application of the inventive principles described below.

Beer tap handles, which are decorated and identified with a particular beer brand, often are used in establishments having low light conditions. Generally, the handles of one brand are adjacent to handles of competitive brands. An illuminated tap handle is more noticeable and easily associated with the brand of beer it represents, thereby giving a competitive advantage to that brand. For example, U.S. Pat. Nos. D396,994, 2,295,468, 2,631,393, 3,286,385, 3,321,861, 4,229,893, 4,894,647, 4,979,641, 5,491,617, 5,586,691 and 5,908,142 describe illuminated tap handles that have the purpose of, or can be used for, that advertising purpose.

To draw attention to the tap handle, it is useful to illuminate intermittently instead of constantly. Constant illumination has the drawback of desensitizing the viewer to its presence. Examples of constant illumination tap handles can be found in the above mentioned U.S. Pat. Nos. D369,994, 2,295,468, 3,286,385, and 3,231,861. Some existing illuminated tap handle systems overcome this problem by illuminating the tap handle when it is actuated. With this method, however, there may be long periods of time between each actuation of the tap handle, resulting in lost advertising opportunity. Examples of such actuated handles are found in the above mentioned U.S. Pat. Nos. 4,229,893, 4,894,647 and 5,491,617.

Several existing illuminated tap handle systems are constructed so that they have external connections either to external power sources or to external drive electronics. Examples of this form of construction are described, for example in U.S. Pat. Nos. 2,295,468, 2,631,393, 3,321,861, 4,225,057, 5,491,617 and 5,908,142. External connections have several disadvantages, including, for example, the possibility of an electrical shock hazard, the use of valuable space in what often are crowded conditions, and the added complication of installing the external components at particular locations.

Self-contained illuminated tap handles are known in the art. In general, these devices have their electrical/electronic systems built completely into the tap handle. While these constructions have the advantages of simpler and less costly installation, lower cost of manufacture and higher reliability, they have not become popular. The self-contained illuminated tap handles known in the prior art have the disadvantage of requiring batteries, either primary batteries, as illustrated in U.S. Pat. Nos. D396,994 and 3,286,385, or secondary (i.e. rechargeable) batteries as illustrated in U.S. Pat. No. 3,321,861. Primary batteries generally have a longer life than secondary batteries, however, given the high power drain needed for illumination of a tap handle, they must be replaced frequently, making them impractical. Secondary battery systems are labor intensive, requiring constant recharging. The recharging device often is relatively large in size, meaning that an external electrical connection to a charger is required. An arrangement with a charger adds both a reliability problem and cost to the system. Some systems attempt to overcome battery life problems by only illuminating during operation of the handle as described by U.S. Pat. No. 4,229,893, or by having a manual switch to turn off the lighting system as described by U.S. Pat. No. 3,286,385.

While the prior art self-contained systems provided for safer operation due to reduced electrical shock hazard (see, for example, U.S. Pat. Nos. D396,944, 3,321,861, 3,286,385 and 4,229,893), their overall construction placed the electrical/electronic system in close proximity to the liquid being dispensed. Such construction has the potential drawback of subjecting the electrical/electronic system to the liquids being dispensed with likely adverse consequences. To overcome this problem, some prior art solutions incorporated the electrical/electronic system in the decorative top portion of the tap handle. However, this solution has the disadvantage of making replacement of the decorative top expensive because replacing the top means that one also has to replace the integral electrical/electronic system contained in the top. For instance, U.S. Pat. Nos. D396,944, 3,286,385, 3,321,861 and 4,894,647 illustrate such arrangements. U.S. Pat. No. 2,145,761 describes a limited solution to this replacement problem by having only a replaceable advertising nameplate. While this is a solution to the cost problem, it is not practical because the product distributor who often owns/installs the delivery system looks unkindly on this type of brand confusion.

Various methods of detecting tap handle actuation also are described in issued U.S. patents. U.S. Pat. Nos. 2,631,393, 4,501,422, 5,491,617 and 5,750,905 describe mechanically actuated switches. U.S. Pat. No. 4,894,647 describes a tilt switch actuated by the tilting of the tap handle. U.S. Pat. Nos. 4,225,057 and 4,229,893 describe motion detection of tap handle actuation. Manual switches require some type of mechanical connection from the fixed portion of the tap to the moveable portion of the tap. This requires a variety of designs to accommodate various existing mechanical tap configurations. A tilt switch does not require a mechanical connection, but has an inherent problem in installations where the handle is already tilted in its normal resting position. Tilt switches often will fail to detect additional tilt when the handle is tilted further during use. Furthermore, a tilt switch may not detect tap handle actuation if the final rotational angle of the tap handle, after it has been screwed onto the tap, is not in line with the sensing direction of the tilt sensor. Vibration sensors, also known in the art, are subject to the same directional problems as tilt sensors.

It is thus apparent that there exists a need for an illuminated dispensing handle which overcomes the various deficiencies noted with respect to the available prior art solutions discussed above.

BRIEF SUMMARY OF THE INVENTION

The present invention provides a draft beverage tap handle. The handle comprises a body portion and a handle portion. The body portion comprises a battery, a light source, a microprocessor, a motion sensor, and a timer. The microprocessor controls electrical current supplied to the light source from the battery. The motion sensor detects when the beverage tap handle has been moved to dispense a beverage. The timer causes electrical current to be interrupted to the light source from the battery when a predetermined period of time has expired. The handle portion is made from a translucent material having an internal cavity for accepting the body portion

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF THE PREFERRED EMBODIMENT

Figure 1:
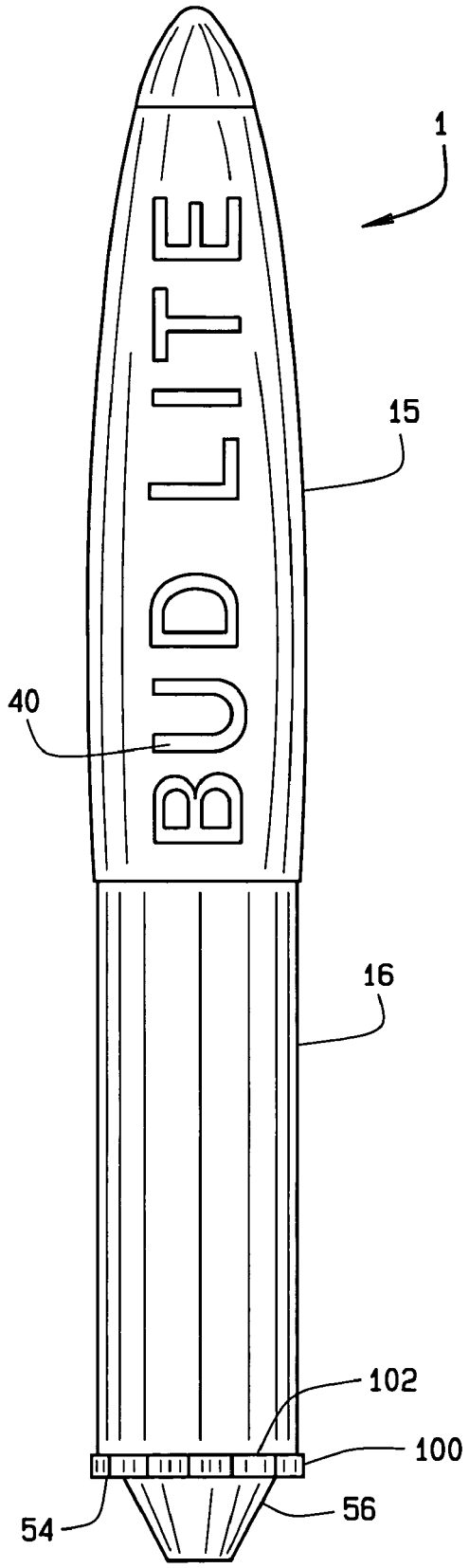
FIG. 1 is a plan view of a tap handle according to an embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

In accordance with the invention, generally stated, an illuminated tap handle system having an interchangeable top handle portion is disclosed. The top handle preferably is constructed from a clear acrylic or other plastic material and includes an open bottom that can be slipped over a base portion in which electronic circuitry is housed.

In the preferred embodiment, the open bottom of the top portion and base are cylindrical in shape. One or more primary batteries are disposed in the base portion. Secondary or other types of batteries may be used, if desired. A first timer is included in the electronic circuit of the base portion for saving battery power and for maximizing advertising effectiveness, which preferably is triggered at the beginning of the business day by a multi-axis motion sensor.

Preferably the first timer expires at the end of the business day after a predetermined period of absence of motion is sensed by the sensor, and upon expiration causes the illumination system to power off. When the timer expires, the system is placed in a substantially zero power mode waiting for sensed motion indicative of the beginning of the next business day.

The electronic circuit of the preferred embodiment also includes a second timer that adjusts frequency of light activity during the business day so that light on-time is at its maximum during hours of peak customer activity, for example during the lunch hour. The pattern of light activity can be adjusted to match any particular duration of business activity, including but not limited to a 24-hour business activity cycle.

The illumination system of the preferred embodiment also includes three light sources consisting of three primary colors, for example, red, green and blue. Any number of colors may be used as necessary to implement the particular color requirements of the tap handle top portion. The light sources are independently adjustable in brightness under control of the electronic circuit to achieve a plurality of perceived colors, including generation of any color in the visible spectrum if desired.

The preferred embodiment also includes one or more switches disposed in the sealed electronic base, accessible when removing or changing the interchangeable top portion. The electronic circuit controls illumination of the light source based on the positions of the switches. Therefore the switches allow the light colors and/or sequence to be changed to correspond to the type and style of the interchangeable top. In an alternative embodiment, the switches can be located in such a way as to be accessible without removal of the interchangeable top, for example with sealed watertight switches, or switches that can be activated automatically by the shape of the interchangeable top portion when the top portion is disposed in the base.

The electronic circuit preferably is a microprocessor adapted to control all aspects of illumination and the operation of the first and second timers. The light source preferably includes at least one light emitting diode (LED).

Referring now to FIG. 1, reference numeral 1 indicates one illustrative embodiment of the tap of the present invention. The tap 1 may comprise a variety of designs, and those skilled in the art will recognize that various designs are compatible with the broader aspects of this invention. The tap 1 preferably is a clear acrylic or other plastic material, and includes a handle portion 15 on which advertising indicia 40 may be deployed. This advertising indicia 40 is optional, in that the invention attracts prospective customers with or without the use of the indicia 40. The tap 1 is, in the embodiment illustrated, an elongated structure having the handle portion 15 and a bottom portion 16. The bottom portion 16 has an axial opening, not shown, extending through it, for the purpose of receiving an electronic base portion 100.

Figure 2:
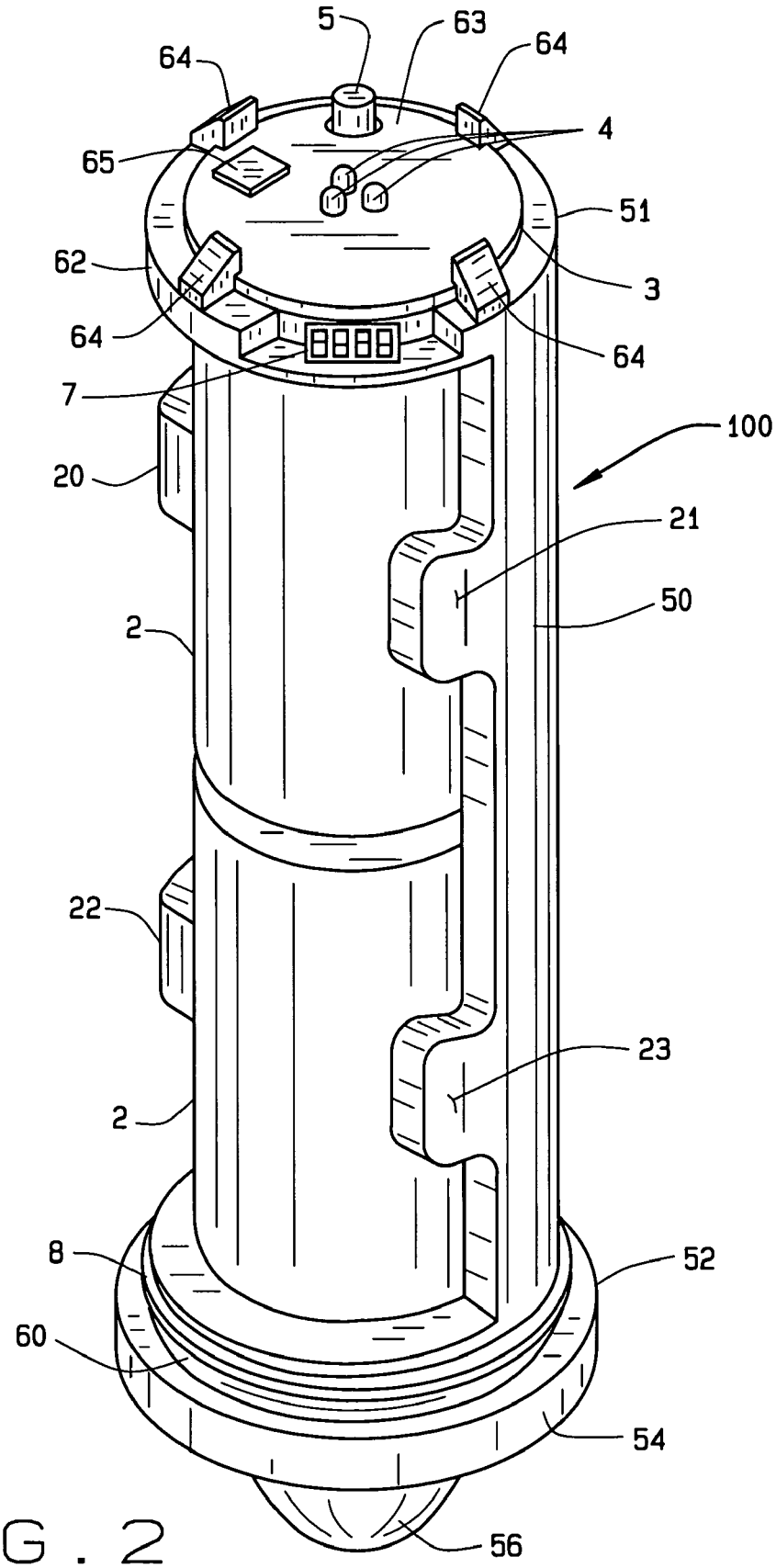
FIG. 2 is a perspective view of a base portion according to an embodiment of the present invention.
Figure 3:
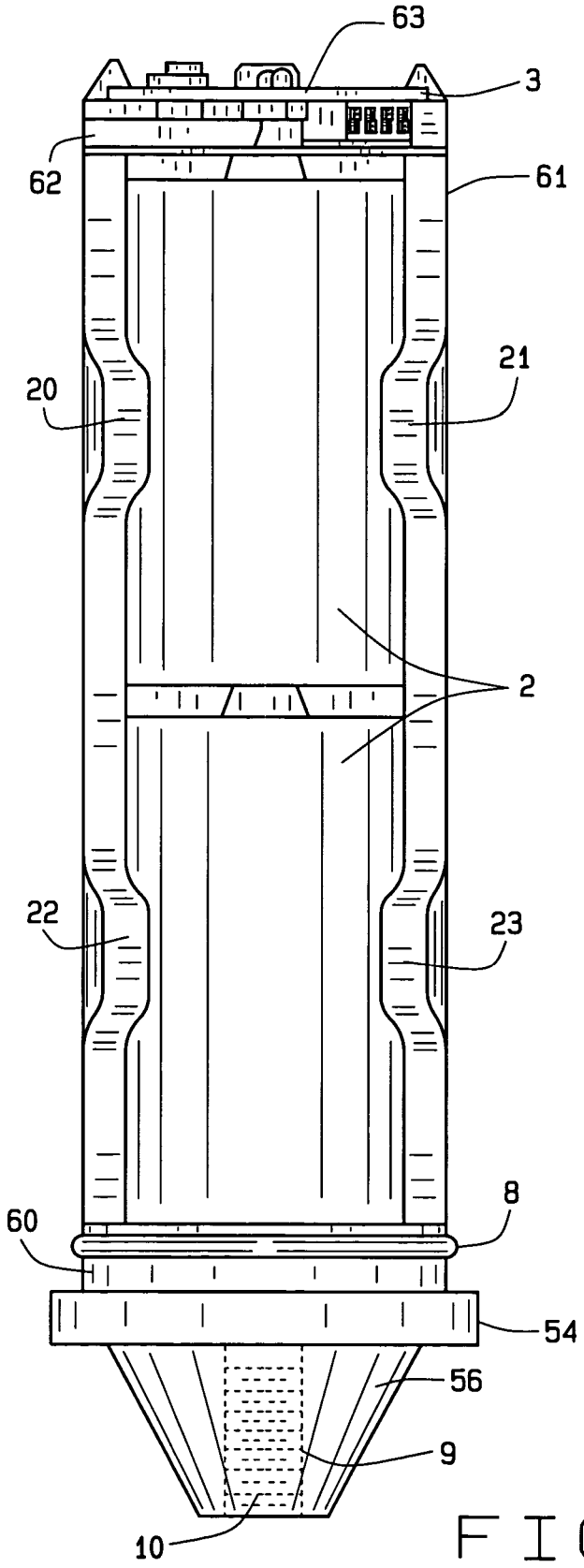
FIG. 3 is a side elevational view of the base portion according to an embodiment of the present invention.
Figure 4:
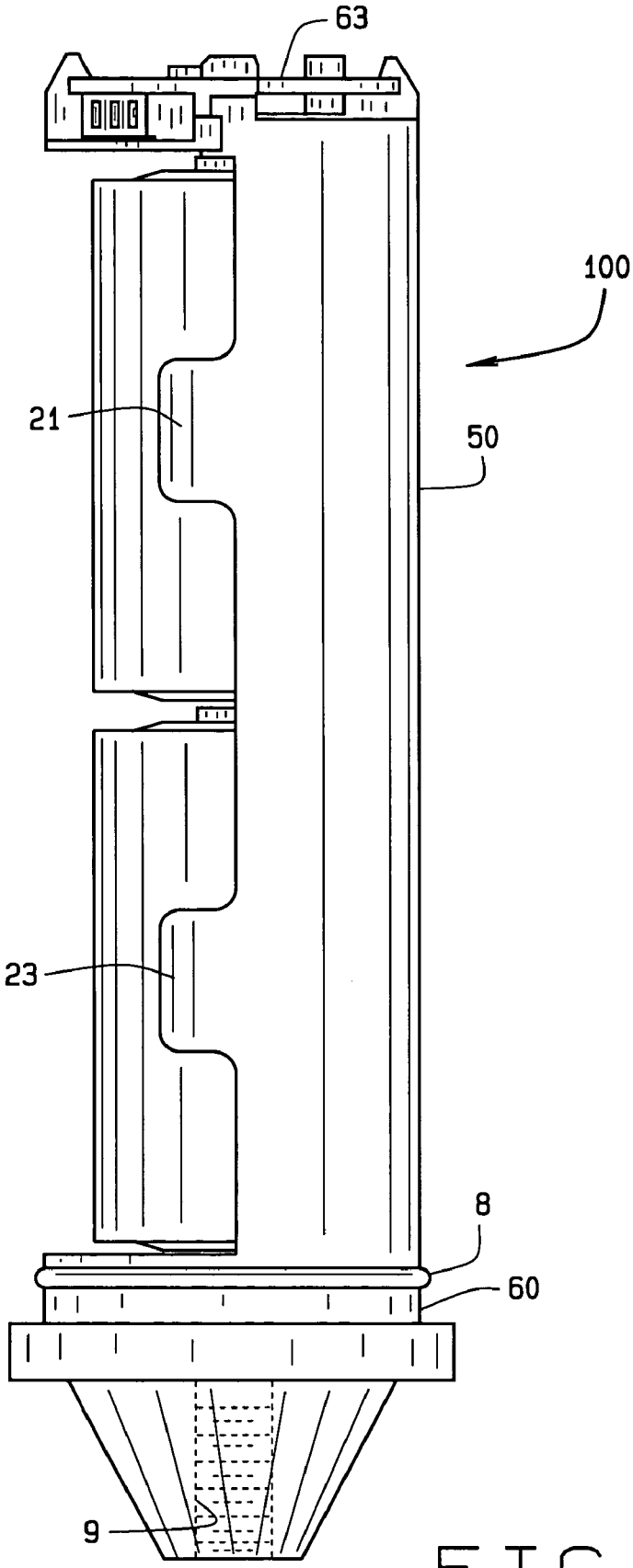
FIG. 4 is a side elevational view of the base portion opposite the view shown in FIG. 3.

As best observed in FIG. 2, the electronic base portion 100 includes a body 50. The body 50 has a top 51 and a bottom 52. The bottom 52 comprises a frusto-conical shape 56 which meets a flange 54. The shape 56 has an opening 9 formed in it. In the embodiment illustrated, the opening 9 (FIG. 3) has a plurality of internal threads associated with it that are utilized to attach the tap 1 to a particular application.

As shown in FIG. 1, the base portion 100 is intended to be received within the opening formed in the bottom 16 of the tap 1 with a distal end 102 of the bottom portion 16 meeting the flange 54 to provide an attractive aesthetic appearance to the combined parts. The flange 54 has an axially upwardly extending portion 60 having an annular groove formed in it, which receives, in the embodiment illustrated, an O-ring 8. The O-ring 8 seals the body 50 within the bottom 16 of the tap 1 and prevents liquids from entering the bottom 16 of the tap 1 in operational use.

Body 50 is of a generally semi-cylindrical construction in the embodiment illustrated, and includes two pairs of arms respectively indicated by the reference numerals 20, 21, 22, and 23. The arms 20 through 23 are relatively flexible, and are intended to permit insertion and removal of a pair of batteries 2. The batteries 2, in the embodiment illustrated, are conventional and an electrical connection 60 extends from the bottom 52 of the body 50 to the upper end 61 of the body 50.

The end 61 generally comprises a circular flange 62 formed about the periphery of the body 50. Flange 62 has a plurality of snap hooks 64 which are integrally formed with the flange 62 and are flexible with respect to it, in order to permit insertion of circuit board 65 thereunder.

Figure 5:
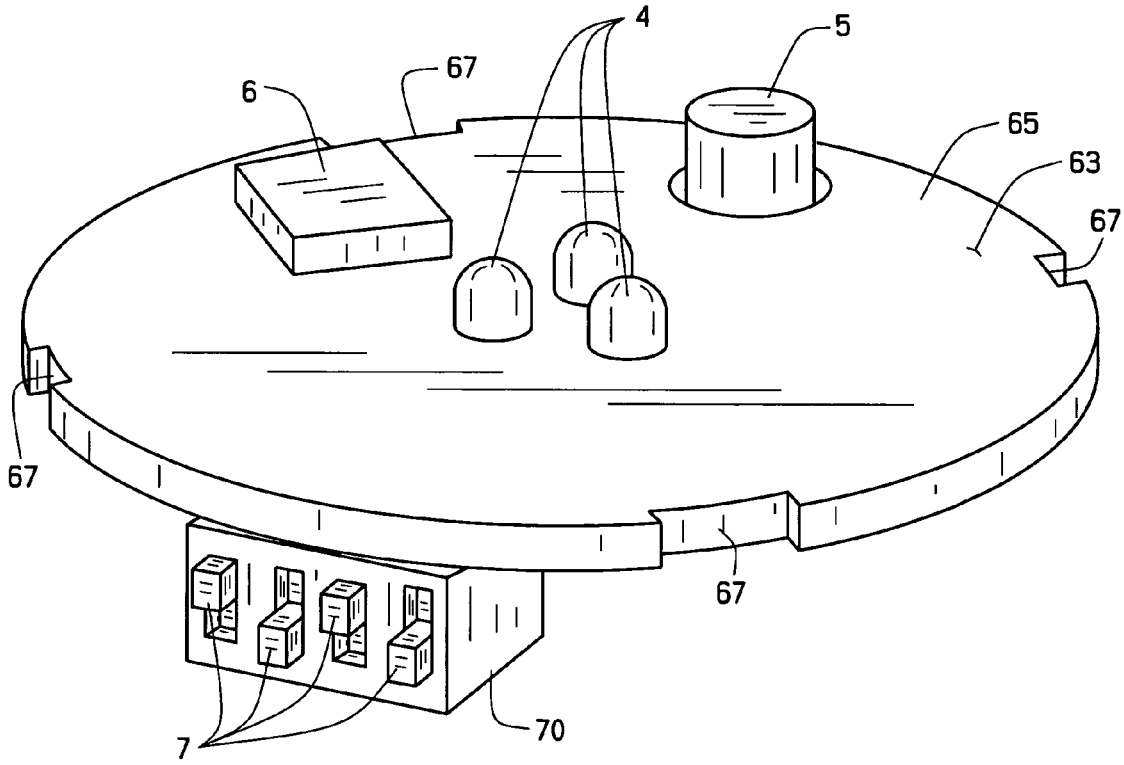
FIG. 5 is a view in perspective of the circuit board of FIG. 2.

Referring now to FIG. 5, the circuit board 65 is generally circular and has a plurality of notches 67 formed in it, which are intended to aid in the positioning, location and holding of the circuit board 65 by the hooks 64. The circuit board 65 has a microprocessor 6 mounted to it, the operation of which is more fully described below. The circuit board 65 also has at least one light emitting diode (LED) 4 mounted to it. In the preferred embodiment, a plurality of LEDs 4 are employed. The board 65 also has a switch box 70 mounted to it, which houses at least one switch 7. Again, preferably, a plurality of the switches 7 are employed in the preferred embodiment of the invention.

Figure 6:
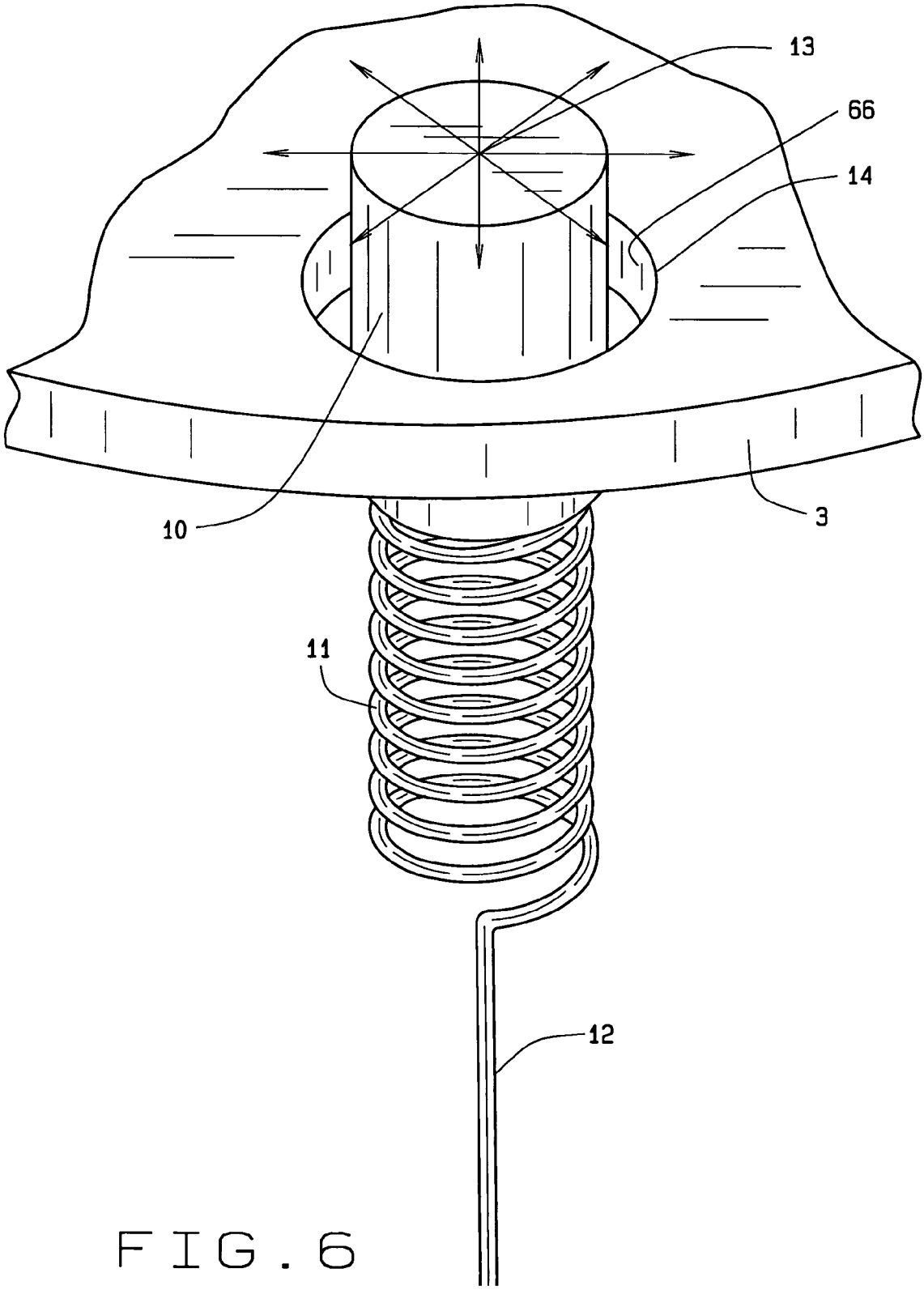
FIG. 6 is a view in perspective, partly broken away, showing the multi-axis motion sensor according to an embodiment of the present invention.

As indicated above, a multi-axis motion sensor 5 is associated with the circuit board 65. The motion sensor 5 is best shown in FIG. 6, in which a preferred embodiment of a multi-axis motion sensor is shown. The sensor 5 preferably is positioned axially upwardly within the tap 1 to produce the greatest possible motion of the sensor 5 when the tap 1 is moved, which will be tangential to a curve centered near the tap 1 mount. The motion sensor 5 includes a mass 10 constructed from a suitable conductive material, which is mounted vertically to a conductive spring 11. Spring 11 has an end 12 which is electrically connected to the microprocessor 6 in a conventional manner. The base 12 also is fixed to the body 50 of the electrical base portion 100.

As indicated in FIG. 5, the mass 10 is centered in an opening 14 in the circuit board 65. An inside surface 66 of the opening 14 preferably is plated with a conductive material. A material such as gold works well, for example, because gold works well as a contact because it does not oxidize or tarnish. Mechanical motion of the base portion 100 during operation of the tap 1 is transmitted to the circuit board 13 because the mass 10 tends to remain stationary, and the mass 10 contacts the conductive inside surface 66 of the opening 14, thereby completing the motion sensing circuit. In the embodiment illustrated, the motion sensor 13 is intended to be mounted approximately vertically relative to the earth so as to be the most sensitive to any possible tap 1 motion and least sensitive to the earth's gravity, thus minimizing the sensor's 5 sensitivity as a tilt switch.

Figure 7:
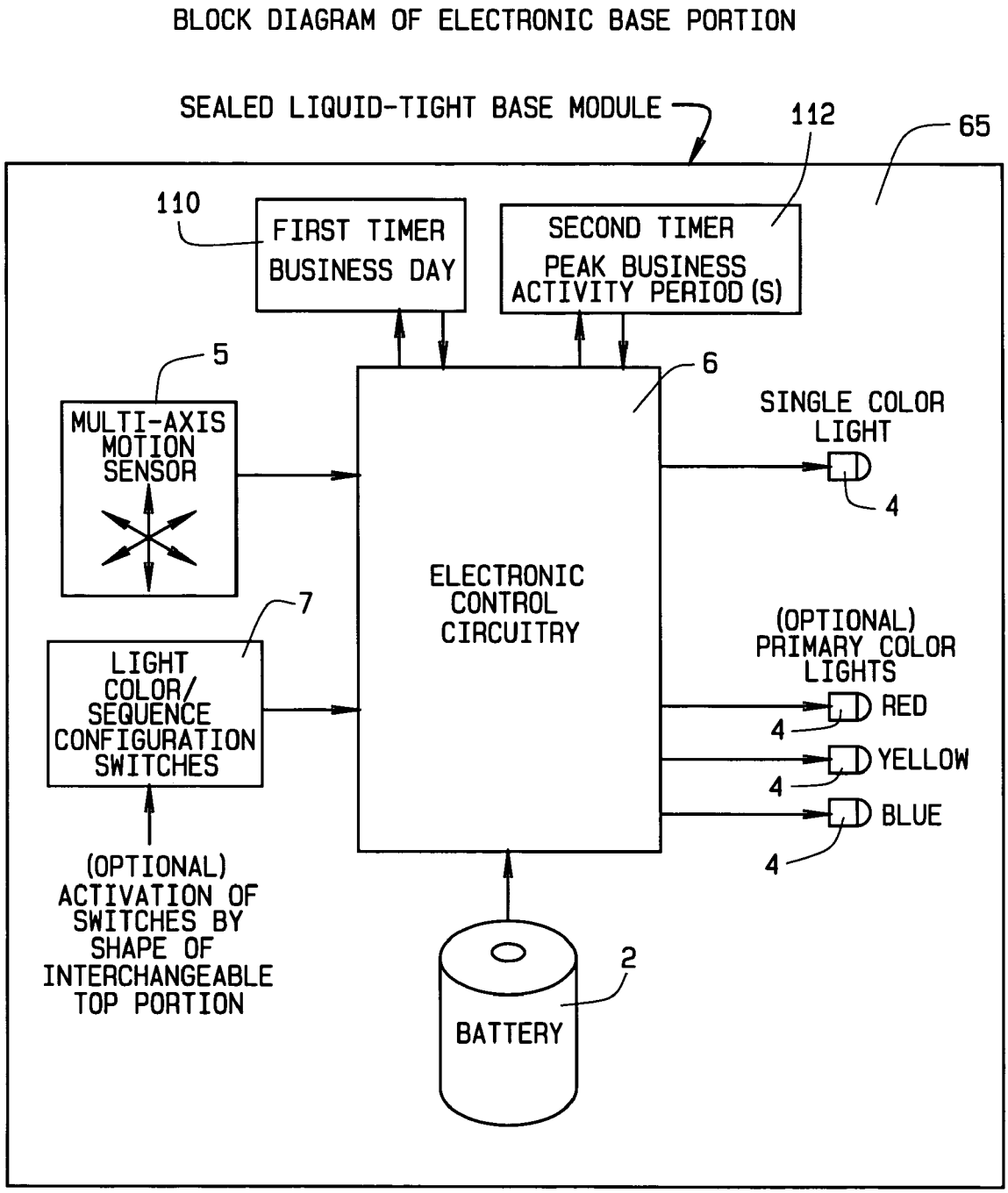
FIG. 7 is a block diagrammatic view of the electric circuit by the tap handle according to an embodiment of the present invention.

Referring now to FIG. 7, the microprocessor 6 which is mounted in a conventional manner to the circuit board 65 is electrically connected to the motion sensor 5, and to at least one of the light emitting diodes 4. As indicated above, preferably a plurality of light emitting diodes 4 exhibiting the primary colors in activation are provided for the greatest visual effect. The batteries 2 also are electrically connected to the microprocessor 6.

As indicated above, the switches 7 are intended to control the operation of the light emitting diodes 4, and the switches 7 are electrically connected to the microprocessor 6. For example, the switches can be used to control the relative intensity of the LEDs 4 or to control a sequence of illumination and de-illumination.

The switches 7 in the embodiment illustrated are changed manually by technical personnel installing the tap 1. As will be recognized by those skilled in the art, alternatively, the switches could be configured so that they are automatically actuated by protrusions in the tap 1 so that the desired switch position is obtained simply by the insertion of the electrical base portion 100 within the tap 1.

As indicated above, the switches 7 are intended to change the lighting behavior of the LEDs to provide increased battery life or change the aesthetics of the lighting pattern. For example, the switches 7 could be set to indicate to the processor to slowly dim and brighten the illumination over time. Dimming of the illumination is achieved by rapidly switching the light source on and off under electronic control at a frequency faster than the human eye can perceive, resulting in perceived partial brightness. This function provides novel and attention getting light activity that improves the advertising value of the system, even though the majority of the time is spent at less than full brightness. Moreover, such illumination control does not require the use of inefficient resistive regulation circuitry.

Fully adjustable color illumination can be provided through the use of three light sources. The relative brightness of each color is controlled by the control circuitry. In the preferred embodiment, three primary colors, red, yellow and blue are used. By adjusting the relative brightness of the three light sources, any color in the light spectrum can be generated and changed over time by the control circuitry to achieve desired aesthetic effects.

Non-visible light sources, such as those in the ultra-violet spectrum, may also be used to illuminate florescent materials in the handle portion, thereby indirectly producing visible light. Adjustable color illumination as described above may be also be achieved by combining two or more non-visible light sources, each source emitting a different band of non-visible light. The visible brightness of each florescent material in the handle is controlled by the brightness of the corresponding band of non-visible light to which the florescent material is sensitive.

In the preferred embodiment, a first timer 110 and a second timer 112 also are electrically connected to the microprocessor 6 or incorporated therein. In operation, after receiving the body portion 100, the tap 1 is attached to its intended environment along the opening 9. At least one LED 4, and preferably a plurality of LEDs 4, is disposed axially on the upper surface 63 of the circuit board 65. In embodiments that are capable of producing the entire spectrum of visible light using three primary color LEDs, the preferred placement of the LEDs is in a tight group, generally as depicted in FIG. 5. This tight grouping has the effect of producing a more homogeneous mixing of the light from the LEDs 4, thereby giving the desired perception of color to the human eye. Alternatively, the LED's could be placed farther apart as desired or necessary to produce other aesthetic multi-color lighting effects.

The timers 110, 112 operate to save battery power by stopping or minimizing electrical current at different times. The timer 110 is intended to interrupt current to the LEDs 4 after a predetermined length of time has expired from the first motion detected by the motion sensor 5. For example, the timer 110 would begin counting down at the first use of the tap 1 after the timer 110 has expired as detected by the motion sensor 5. The length of time counted by the timer 110 would be equivalent to the length of the establishment's business hours, such that the timer 110 stops electrical current through the LEDs 4 at the end of the business day. Alternatively, the first timer 110 could have a timeout value that caused electrical current to be interrupted to the LEDs when the tap 1 has not been operated in a some other predetermined length of time.

The timer 112 would be a secondary timer to cause the brightness of the LEDs 4 to vary based upon the time of day. Savings of battery power is provided by automatically adjusting the frequency of light activity during the business day so that light on-time is at its maximum during hours of peak customer activity, and light on-time is at its minimum during hours of low customer activity. For example, during the lunch hour, light on-time could be near 100 percent, while other hours light on-time could be to closer to 0 percent.

Moreover, the microprocessor 6 may count the frequency of uses of the tap 1 within a period of time and adjust the LED 4 brightness based upon frequency of use.

A randomization circuit disposed in the electronic base portion may or may not initiate the different light sequence upon actuation of the tap, depending on the average frequency of occurrence desired for the particular promotion. The different light display can signify any of various events such as a free beer for the patron who's glass is being filled at the time.

A light display mode may also be provided for use in conjunction with product promotions whereby the light display changes to a substantially different light sequence during a particular time of the day, e.g. happy hour, during which any of various promotions take place, e.g. beer for half price, as signified by the substantially different light sequence.

A light display mode may also be provided for use in conjunction with product promotions whereby the light display changes to a substantially different light sequence at a random time of day for a fixed time period of time, e.g. ten minutes, during which any of various promotions take place, e.g. beer for half price, as signified by the substantially different light sequence.

Figure 8:
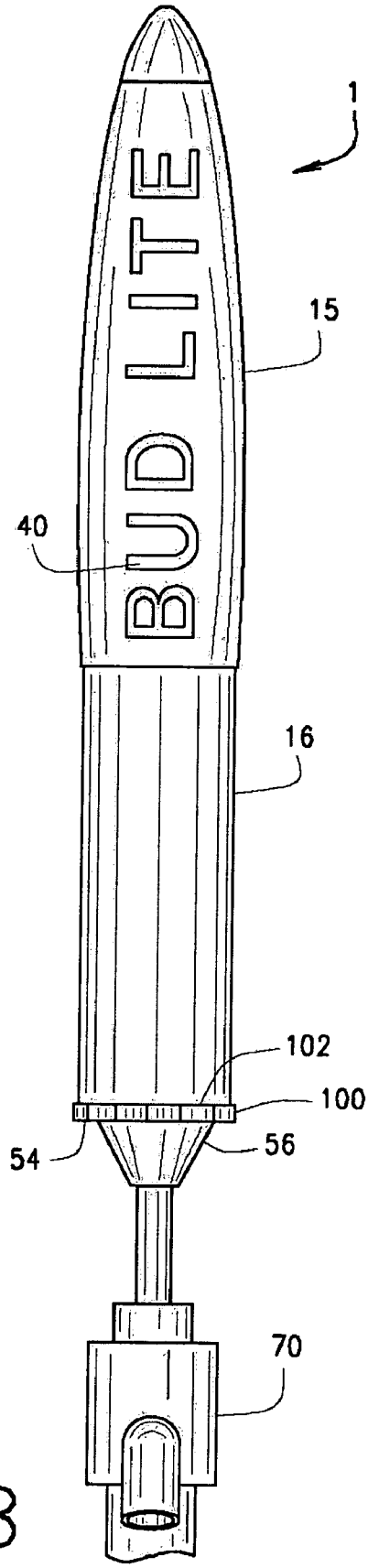
FIG. 8 is a plan view of the tap handle of the present invention attached to a valve for dispensing a beverage.

Referring to FIG. 8, there is provided the tap handle of FIG. 1 attached to a prior art valve 700 for dispensing a beverage.

In view of the above, it will be seen that several advantages of the present invention have been achieved and other advantageous results have been obtained.

We claim:

1. A draft beverage tap handle comprising:

a draft beverage tap handle including:

a body portion comprising:

a battery;

a light source;

a microprocessor for controlling electrical current supplied to the light source from the battery;

a motion sensor for detecting when the beverage tap handle has been moved to dispense a beverage; and a timer for causing electrical current to be interrupted to the light source from the battery when a predetermined period of time has expired;

a handle portion made from a translucent material having an internal cavity for accepting the body portion; and a valve operatively associated with the handle for dispensing a beverage.

2. The tap handle of claim 1 wherein the motion sensor comprises a multi-axis motion sensor comprising a mass constructed from a suitable conductive material mounted vertically to a conductive spring, the spring has an end which is electrically connected to the microprocessor, the mass is mounted within a bore having a conductive wall such that when the conductive wall is moved, inertia causes the spring-mounted mass to contact the wall to momentarily complete an electrical circuit from the spring to the wall through the mass.

3. The tap handle of claim 1 wherein the light source comprises a light emitting diode.

4. The tap handle of claim 1 wherein the timer is reset every time the motion detector detects motion of the tap handle.

5. The tap handle of claim 1 wherein the body portion further comprises a second timer for controlling the intensity of the light source based upon the present time of day.

6. The tap handle of claim 1 wherein the body portion further comprises a second timer for causing the light source to be illuminated intermittently.

7. The tap handle of claim 1 wherein the body portion further comprises a plurality of light emitting diodes and a plurality of switches attached to the microprocessor for controlling the relatively intensity of each of the light emitting diodes.

8. The tap handle of claim 1 wherein the body portion further comprises a plurality of light emitting diodes and a plurality of switches attached to the microprocessor for controlling a sequence in which the light emitting diodes are illuminated and un-illuminated.

9. The tap handle of claim 1 further comprising an O-ring disposed between the handle portion and the body portion to prevent liquids from entering the cavity.

10. The tap handle of claim 1 further comprising a randomization circuit for providing a change in the light source illumination sequence or color based upon a random detection of motion of the tap handle.

11. The tap handle of claim 1 further comprising a randomization circuit for providing a change in the light source illumination sequence or color based upon expiration of a random length of time.

12. The tap handle of claim 1 wherein the handle portion contains florescent materials and the light sources emit non-visible light that causes the illumination of the florescent materials within the handle portion.

13. A tap handle comprising:

a body portion comprising:

a battery;

a light source;

a microprocessor for controlling electrical current supplied to the light source from the battery;

a motion sensor for detecting when the beverage tap handle has been moved to dispense a beverage;

a timer for causing electrical current to be interrupted to the light source from the battery when a predetermined period of time has expired; and a second timer for controlling the intensity of the light source based upon the present time of day; and a handle portion made from a translucent material having an internal cavity for accepting the body portion.

14. The tap handle of claim 13 wherein the motion sensor comprises a multi-axis motion sensor comprising a mass constructed from a suitable conductive material mounted vertically to a conductive spring, the spring has an end which is electrically connected to the microprocessor, the mass is mounted within a bore having a conductive wall such that when the conductive wall is moved, inertia causes the spring-mounted mass to contact the wall to momentarily complete an electrical circuit from the spring to the wall through the mass.

15. The tap handle of claim 13 wherein the light source comprises a light emitting diode.

16. The tap handle of claim 13 wherein the timer is reset every time the motion detector detects motion of the tap handle.

17. The tap handle of claim 13 wherein the body portion further comprises a plurality of light emitting diodes and a plurality of switches attached to the microprocessor for controlling the relatively intensity of each of the light emitting diodes.

18. The tap handle of claim 13 wherein the body portion further comprises a plurality of light emitting diodes and a plurality of switches attached to the microprocessor for controlling a sequence in which the light emitting diodes are illuminated and un-illuminated.

19. The tap handle of claim 13 further comprising an O-ring disposed between the handle portion and the body portion to prevent liquids from entering the cavity.

20. The tap handle of claim 13 further comprising a randomization circuit for providing a change in the light source illumination sequence or color based upon a random detection of motion of the tap handle.

21. The tap handle of claim 13 further comprising a randomization circuit for providing a change in the light source illumination sequence or color based upon expiration of a random length of time.

22. The tap handle of claim 13 wherein the handle portion contains florescent materials and the light sources emit non-visible light that causes the illumination of the florescent materials within the handle portion.

23. A tap handle comprising:

a body portion comprising:

a battery;

a light source;

a microprocessor for controlling electrical current supplied to the light source from the battery;

a multi-axis motion sensor for detecting when the beverage tap handle has been moved to dispense a beverage, the motion sensor comprising a mass constructed from a suitable conductive material mounted vertically to a conductive spring, the spring has an end which is electrically connected to the microprocessor, the mass is mounted within a bore having a conductive wall such that when the conductive wall is moved, inertia causes the spring-mounted mass to contact the wall to momentarily complete an electrical circuit from the spring to the wall through the mass;

a timer for causing electrical current to be interrupted to the light source from the battery when a predetermined period of time has expired; and a second timer for controlling the intensity of the light source based upon the present time of day; and a handle portion made from a translucent material having an internal cavity for accepting the body portion.

24. The tap handle of claim 23 wherein the light source comprises a light emitting diode.

25. The tap handle of claim 23 wherein the timer is reset every time the motion sensor detects motion of the tap handle.

26. The tap handle of claim 23 wherein the body portion further comprises a plurality of light emitting diodes and a plurality of switches attached to the microprocessor for controlling the relatively intensity of each of the light emitting diodes.

27. The tap handle of claim 23 wherein the body portion further comprises a plurality of light emitting diodes and a plurality of switches attached to the microprocessor for controlling a sequence in which the light emitting diodes are illuminated and un-illuminated.

28. The tap handle of claim 23 further comprising an O-ring disposed between the handle portion and the body portion to prevent liquids from entering the cavity.

29. The tap handle of claim 23 further comprising a randomization circuit for providing a change in the light source illumination sequence or color based upon a random detection of motion of the tap handle.

30. The tap handle of claim 23 further comprising a randomization circuit for providing a change in the light source illumination sequence or color based upon expiration of a random length of time.

31. The tap handle of claim 23 wherein the handle portion contains florescent materials and the light sources emit non-visible light that causes the illumination of the florescent materials within the handle portion.

* * * * *